US007469569B2

(12) United States Patent
Webb

(10) Patent No.: US 7,469,569 B2
(45) Date of Patent: Dec. 30, 2008

(54) WIRE DRAWING DIE AND METHOD OF MAKING

(75) Inventor: Steven W. Webb, Worthington, OH (US)

(73) Assignee: Diamond Innovations, Inc., Worthington, OH (US)

( * ) Notice: Subject to any disclaimer, the term of this patent is extended or adjusted under 35 U.S.C. 154(b) by 0 days.

(21) Appl. No.: 10/595,738

(22) PCT Filed: Dec. 9, 2004

(86) PCT No.: PCT/US2004/041488

§ 371 (c)(1),
(2), (4) Date: May 8, 2006

(87) PCT Pub. No.: WO2005/058519

PCT Pub. Date: Jun. 30, 2005

(65) Prior Publication Data

US 2007/0090538 A1 Apr. 26, 2007

Related U.S. Application Data

(60) Provisional application No. 60/528,372, filed on Dec. 10, 2003.

(51) Int. Cl.
*B21C 3/02* (2006.01)

(52) U.S. Cl. ..... 72/467; 76/107.4

(58) Field of Classification Search ..... 72/467; 76/107.4

See application file for complete search history.

(56) References Cited

U.S. PATENT DOCUMENTS

| | | | | |
|---|---|---|---|---|
| 1,597,927 | A | | 8/1926 | Simons |
| 2,027,787 | A | | 1/1936 | Ridgway et al. |
| 3,350,743 | A | * | 11/1967 | Ishizuka ..... 425/77 |
| 3,831,428 | A | | 8/1974 | Wentorf, Jr. et al. |
| 4,016,736 | A | | 4/1977 | Carrison et al. |
| 4,145,910 | A | | 3/1979 | Scheel |
| 4,241,625 | A | | 12/1980 | Corbin et al. |
| 4,260,397 | A | | 4/1981 | Bovenkerk |
| 4,392,397 | A | | 7/1983 | Engelfriet et al. |
| 5,110,579 | A | | 5/1992 | Anthony et al. |
| 5,361,621 | A | | 11/1994 | Anthony et al. |
| 5,957,005 | A | | 9/1999 | Einset et al. |

FOREIGN PATENT DOCUMENTS

WO WO 79/00208 4/1979

OTHER PUBLICATIONS

H. Tracy Hall, "Hydraulic Ram Design for Modern High Pressure Devices", The Review of Scientific Instruments, vol. 37, No. 5, May 1966, pp. 568-571.

J. Groenbaek et al. "Optimization of Tool Life & Performance Through Advanced Material and Prestress Design", ICFG/NACFG International Cold Forging Conference, Columbus, Ohio, Sep. 2-3, 2003, pp. 1-10.

* cited by examiner

*Primary Examiner*—Daniel C Crane
(74) *Attorney, Agent, or Firm*—Pepper Hamilton LLP

(57) ABSTRACT

The present invention relates to a die comprising a die core (10) of a hard material and at least two pre-stressed rings (60, 70) of increasing diameter placed around the die core and methods of making and using the same. The die core (10) is held in place by a force generated through deformation of mating geometric features on the die and the rings (60, 70) of increasing diameter.

20 Claims, 1 Drawing Sheet

WIRE DRAWING DIE AND METHOD OF MAKING

RELATED APPLICATIONS AND CLAIM OF PRIORITY

This application is the U.S. national phase of PCT/US2004/041488, filed Dec. 9, 2004, which claims priority to U.S. Application No. 60/528,372, filed Dec. 10, 2003, herein incorporated by reference in its entirety.

TECHNICAL FIELD

The present invention relates to a novel diamond wire drawing die having a die core and at least two pre-stressed metal rings, a method of using the same, and a method for manufacturing the same.

BACKGROUND

Dies have been used to deform, shape or form metal wire, fiber, rod, cylinder or bar stock, and similar materials. Dies are typically fabricated in the art by attaching a hard, wear- and chip-resistant die core to a softer and tough housing or container, wherein the container material may be shaped more easily than the hard die core to allow rigid reversible attachment to the drawing or extruding machine. The attachment of the hard die core to the housing may be made with a braze, a combination of braze and solder adhesion, a variety of wedges such as interference, a press or thermal-shrink fit, or a sinter process.

Dies may be used to reduce the diameter of a wire, to create a surface roughness on a stock material, or to create a useful shape or profile from the stock material through processes such as wire drawing and extrusion. In a wire drawing process, wire may be pulled through a hole or draw passage in a die core, typically under high tension and at high speed. A wire may be reduced in diameter, wherein the draw passage diameter is less than that of the wire being pulled through the passage. In an extrusion process, a metal bar stock may be pushed through a shaped die to impart a specific profile which may be subsequently cut and bent into usefully articles. In extrusion processes, a hole or profile may be machined, cut or drilled into the die to impart a particular shape, dimension, and/or surface texture for the article.

Because a workpiece is being forced through the die core to impart a shape or reduce dimensions, the workpiece is deformed, creating internal pressure on the die. Drawing or extruding a non-linear shape into a workpiece creates significant internal and non-uniform stresses on the die. Various approaches may be used to manage material non-linear elastic and plastic deformations of the wire or bar stock in order to achieve the desired final article dimension. Such deformation of the workpiece may be known as die swell. Such techniques may include polishing the inner diameter of the die core (the opening of the draw passage). Polishing may control die wear and impart a finished surface on the shaped workpiece. To guide a workpiece through the draw passage, a cone or similar shape may be machined in the soft container material.

Typically, die cores experience wears, chips, and/or micro cracks of the inner diameter of the core, causing the wire or extruded article diameter, shape and/or surface finish to deviate over time. At a threshold level of deviation in article shape, diameter or surface, the die core may be removed. A larger diameter draw passage or profile may be formed in the die core, removing the chip, crack or damage. The die core may then be reused in shaping larger workpieces, such as a metal wire or bar stock. The die is then removed and a larger diameter hole or profile is drilled and/or polished. This process may be repeated until the draw passage or profile reaches about 50% of the diameter of the die core, or until a large crack develops in the die. At this point and with a high wear rate, the die may be retired from use.

In drawing lubricated wire or bar stock, the shear strength of the wire or bar and the deformation rate determine the internal pressure subjected to the die. Harder, less deformable wire, drawn at faster speeds, with larger diameter changes in a small die bearing area increases the pressure on the die. A die lifetime is related to the ratio of applied internal pressure, the die tensile strength, die material selection, and the geometry of the die. The reduction in strength as the die wall thins may be predicted by the uniform, isotropic, low-strain, elastic, single-body Lame equation for maximum bearable internal pressure, P, for a die of tensile (hoop) strength T, wall thickness, t, and inner diameter, $D_i$, shown below (Hall, Rev. Sci. Instr., 37(5), 568-571, 1966). In the equation shown below, as the wall gets thinner, P approaches zero. In other words, the maximum bearable pressure a given die of strength T can support vanishes as the wall wears down. The maximum bearable pressure for a thick die is limited to material strength, T and reaches 60% of that strength for w=2. The maximum incremental improvement in strength with die wall thickness occurs for w approaching 1 or for a thin ring of support.

$$P = T\left[\frac{w^2 - 1}{w^2 + 1}\right]$$

$$w = 1 + 2t/D_i.$$

Limits to die lifetime typically manifest as chipping, cracking and progressive diameter increase and/or loss of shape precision. Longer lasting dies making more precise shapes at high production rates with better surfaces require higher strength dies.

The apparent strength, T, of the die is the superposition of intrinsic material strength (derived from its manufacture), geometry (w) and any external applied stress that counteracts the internal pressure in use. Uniform external compression is frequently used to counter uniform internal pressure and strengthen die materials.

Compression on the die can be achieved by shrinking a material around the die. One approach in the art is co-sintering a hard diamond die inside a carbide ring. An example of such an approach is described in U.S. Pat. No. 4,016,736 to Carrison et al., which is incorporated herein by reference in its entirety. This method creates high compression via chemical bonding, thus ideally imposes no tensile stresses on the materials. The compression developed depends on the extent of sintering, strength of the particle bonds and defects. In practice however, non-uniform shrinkage and defects creates local tensile stresses and shape distortion in the sintered bodies, which limit compression.

Another approach is disclosed in International Patent Application Publication No. WO 79/00208, filed by Bieberich, incorporated herein by reference in its entirety, wherein compression and attachment of a die is achieved via powder metal sintering and melting. The metal powder shrinks and contracts around the diamond die creating compression, ideally without tension. Compression developed this way is limited by the thermal stability of the die, restricting this method to low melting, soft metals or incomplete sintering.

U.S. Pat. No. 4,392,397 to Engelfriet et al., incorporated herein by reference in its entirety, discloses a different approach wherein the co-sintered carbide ring is replaced with a steel ring press fit around the die material, wherein the ring may be hardened by thermal treatment to increase compression on the die. This method creates high tensile stresses in the steel ring directly proportional to the compression on the die. These tensile stresses can crack the steel ring placing a limit on the compression achieved by this approach.

U.S. Pat. No. 5,957,005 to Einset et al., incorporated herein by reference in its entirety, discloses a method of improving die compression by shaping the sinter-bonded carbide sleeve to redistribute the compression on the PCD die derived from the sintered carbide. Compression improved this way is of course restricted to the PCD die to which it is permanently sinter-bonded.

Another method of providing compression is by wrapping a thin steel ribbon under tension around a die as reported in Groenbaek, "*Optimization of tool life & performance through advanced material and prestress design*", ICFG/NACFG International Cold Forging Conference, Columbus, Ohio, Sep. 2-3, 2003. This design may also be viewed at http://www.strecon.com/Products. The completed wrap may be welded or crimped to hold the compression. After welding, discrete steel rings may be placed around the steel ribbon to provide reinforcement. However, this technique requires special steel tensioning and welding equipment, which results in expensive processing and expensive die products. In addition, the resulting container system is not disposable.

There is still a need for an improved diamond wire drawing die with extended service time and capability to draw larger diameter wire and forms for a given die diameter. There is also a need for an improved diamond wire drawing die that resists sliding wear, bulk bending and friction heat (thermal expand/contract or thermal-chemical wear). This need extends to low cost, flexibility, and reliable compression systems for many different sizes and types of dies.

The present invention is directed to solving one or more of the problems described above.

SUMMARY

In an embodiment, a container system is used to improve compression on a die. The system includes at least two prestressed rings, wherein an outer ring has a greater diameter than an inner ring. The rings may be shrink fit, press fit, or otherwise formed around each other and the die to form a rigid container.

DETAILED DESCRIPTION

Before the present compositions and methods are described, it is to be understood that this invention is not limited to the particular processes, compositions, or methodologies described, as these may vary. It is also to be understood that the terminology used in the description is for the purpose of describing the particular versions or embodiments only, and is not intended to limit the scope of the present invention which will be limited only by the appended claims.

It must also be noted that as used herein and in the appended claims, the singular forms "a", "an", and "the" include plural references unless the context clearly dictates otherwise. Thus, for example, reference to a "metal" is a reference to one or more metals and equivalents thereof known to those skilled in the art, and so forth.

Unless defined otherwise, all technical and scientific terms used herein have the same meanings as commonly understood by one of ordinary skill in the art. Although any methods and materials similar or equivalent to those described herein may be used in the practice or testing of embodiments of the present invention, the preferred compositions, methods, devices, and materials are now described. All publications mentioned herein are incorporated by reference in their entirety. Nothing herein is to be construed as an admission that the invention is not entitled to antedate such disclosure by virtue of prior invention.

Figure 1:
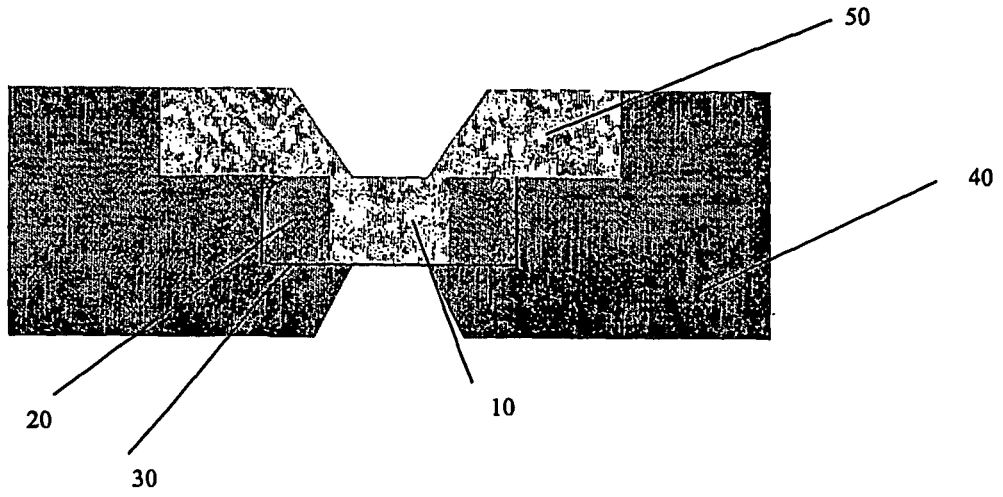
Figure 1 Prior Art
FIG. 1 is a cross-section view of a wire drawing die in the prior art.

Referring first to FIG. 1, a wire drawing die in the prior art is illustrated for comparison purpose. As shown, the wire-drawing die comprises a hard, sintered diamond die or core 10 integrally bonded to a carbide housing 20, and attached to a steel container 40 and steel cap 50 via a braze metal layer 30. Wire guide angles (not shown) may be machined into the steel container. In the co-sintered die configuration, the carbide ring 20 is bonded to the sintered diamond die 10 to provide a non-deformable and rigid interface. While this configuration increases compression, it does so with an increased risk of cracks. A crack formed at the high-tensile stressed inner diameter can cause the entire ring to fail. A crack spanning the entire ring will ruin compression on the sintered diamond die. The uncompressed die will support very little internal pressure.

Figure 2:
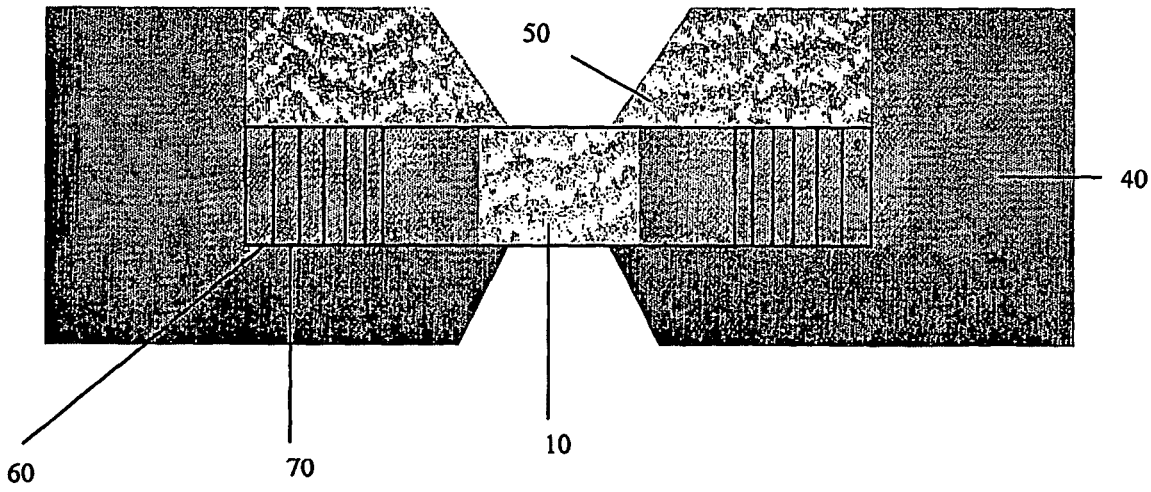
FIG. 2 is a cross-section view of a diamond wire drawing die wherein a set of pre-tensioned rings is used to increase compression on the die.

Referring to FIG. 2, an embodiment of an improved wire-drawing die also comprises a hard abrasive die or core 10. The core 10 is housed within a ring container "system" which creates a compression around the hard core via tensile stress by interference, thermal contraction, thermal shrink via heat-treat, chemical-shrink or other external means. The housing container system may include a carbide housing 20, and it may also comprise at least two rings or partial rings such as 60 and 70 of any thickness or shape. The at least two rings are rings of increasing diameter as the rings are positioned around the die core. The rings may be concentric, meaning that the rings may share a common center (the die core). The rings may be of differing heights, thicknesses or orientation around the die core. The rings may be derived from any number of materials e.g. foil, wire, and the like, each ring being of the same or different materials, e.g., metal, fiber, and the like, fabricated to the same or different tolerances including diameters, surface roughness, chamfers and/or tapers. The die may also include a container 40 and cap 50 made of a rigid material such as steel, iron, brass, or metallic alloys. Examples of suitable containers are described in U.S. Pat. No. 4,392,397 to Engelfreit et al., which is incorporated herein by reference in its entirety.

Hard Die Core. The abrasive hard core 10 may be made of any material that is less deformable (harder) or more abrasion resistant than the workpiece material that will be drawn or extruded through the core. Optionally, the hard core 10 may be made of a material that is also more abrasion resistant than the material comprising the container system 40. For example, the core 10 may comprise a hard material such as silicon nitride, silicon carbide, boron carbide, titanium carbide-alumina ceramics such as titanium carbide, fused aluminum oxide, ceramic aluminum oxide, heat treated aluminum oxide, alumina zirconia, iron oxides, tantalum carbide, cerium oxide, garnet, cemented carbides (e.g., a tungsten carbide/cobalt composition), synthetic and/or natural diamond, polycrystalline diamond, zirconium oxide, cubic boron nitride, laminates of these materials, mixtures, and/or composite materials thereof. These materials can be in the form of single crystals or sintered polycrystalline bodies.

An example of a material comprising the hard core is polycrystalline diamond (PCD) or an aggregate of synthetic diamond, which is commercially available from a number of sources, including the synthetic diamond available from Diamond Innovations, Inc. of Worthington, Ohio, under the trade name COMPAX®. In one embodiment and as delivered, the aggregate of synthetic diamond is usually attached to, or supported/contained by an integrally bonded carbide shell. In another embodiment, the PCD core may be in the form of a freestanding annular ring.

In another example, the hard core comprises PCD with a very low defect content/concentration as the property of core material affects the compressive strength (shear strength) as imposed on by the ring container housing system, so that new compression can be tolerated with minimal chance of cracking.

The die core (inner and outer profile) of the present invention is optimally circular, cylindrical, elliptical, polygonal, or trapezoidal in shape with rounded corners, to optimally support uniform radial compression for uniform internal stresses. In one embodiment of the invention, the die core profile is circular in shape. In another embodiment, the die core profile is elliptical in shape. In yet another embodiment, the die has a cylinder shape.

Examples of suitable core compositions and methods of making suitable cores are disclosed in U.S. Pat. No. 3,831,428, to Wentorf al.; U.S. Pat. No. 5,110,579 to Anthony et al.; and U.S. Pat. No. 5,361,621 to Anthony et al., each of which is incorporated herein by reference in its entirety.

Ring Container Housing/System. The hard core 10 may be in a freestanding form or it may be supported/contained within a carbide ring 20, and housed in a ring container system. The "container system" comprises a at least two rings, i.e., at least two distinct rings such as 60 and 70 of increasing diameter which compress the die material and thus increase the hoop strength as seen in FIG. 2. Dies having a diameter of about 1 to about 50 mm may be manufactured and used to draw wire.

As used herein, "ring" refers to a sleeve or a band of material for holding and/or closing and/or forming a loop around the hard core. The ring may be closed as in a "ring," partially closed, such as in a split ring or a lock washer, or open, such as in the form of a wrap-around wire. The ring surface may be smooth as with a washer or ring, or uneven as with a twisted thread or a braided wire. The rings may be pre-stressed before being fitted around a die core. As used herein, "pre-stressed" generally means that the ring has been deformed (e.g., shape or volume change) without material removal. The rings may be pre-stressed (e.g., pre-compressed) by, for example, pressing them inside each other with dimensional overlap or interference.

Additionally, the rings may be deformed by hot and cold work, annealing, tempering, and/or hardening, such that the material properties of the steel ring are altered. The machined, ground, chamfered, molded, and/or forged rings may be pre-stressed or shaped or volume changed, thus putting the ring in a higher state of stress. Some deformation is elastic, meaning one could reshape the ring out, relieve the stress and restore the original dimensions. If deformation may be elastic, the ring may be restored to its original dimensions and thus reused. If a ring is simply deformed elastically, the compression generated by a ring is limited. Preferably, the rings of the present invention may be in an embodiment deformed plastically, meaning that the ring is deformed irreversibly, usually via a shape change. Plastic deformation is generally inexpensive, since there is no need to precision fit and control the deformation. Thus, as used herein "pre-stressed" means that a ring is deformed either plastically or both elastically and plastically. Since the rings are deformed, dies containing the pre-stressed rings may be designed for one-time, disposable use. In one embodiment, a pre-stressed, plastically deformed ring may be ground or machined to clean up the irregular dimensions from the yielded material.

The at least two rings of increasing diameter in the ring container system may be of the same material for all of the rings in the system, or they may be of different materials for the different rings in the system. In an embodiment, the ring material is less hard than the material making up the die core. The rings may comprise any material that has a high tensile strength and facility to be precisely machined with tapers, tight tolerance, chamfers, etc., including metals and fiber reinforced composite materials. In one embodiment of the invention, the at least two rings of increasing diameter in the container housing comprise a metal alloy which has good heat conductivity, such that the heat generated during drawing or supplied by the hot wire can be dissipated. Metal alloys suitable for use as ring materials include brass, hardened aluminum alloys, ferrous alloys, copper alloys, and the like. In one embodiment of the invention, different materials are used for different rings such that the ring material hardness is progressively increased outward with the container diameter. This option may help to support increased tension in the ring set and apply even greater compression to the die.

With respect to the ring dimensions, each ring in the container system may be of the same or different thickness. In one embodiment of the invention, the rings in the container system are of the same thickness. In another embodiment of the invention, the ring thickness is progressively increased outward with the container diameter with the outer rings being thicker than the inner rings) to support increased tension in the ring set. In another embodiment of the invention, the ring thickness is designed such that the majority of the ring volume is at a near-yield, but not yielded state. As used herein, "yielded state" means a state of irreversible deformation, wherein a part may not return to an original dimension even if a stress is removed. For example, when steel is stretched to these high strains, it does not act as a single uniform body. The wall thickness of the ring is limited by yield. If the rings are too thin, they could be uniformly yielded and stress is lost. If the rings are too thin, the rings could crack and the die core could fall out. Conversely, if the rings are too thick, they may not be plastically deformed. Therefore, since a pre-stressed ring is both elastically and plastically deformed, the rings are at a near-yield state, but not a yielded state. A suitable range of ring thicknesses may be used such that elastic and plastic deformation occurs, but that a yielded state is not reached.

In one embodiment of the invention, the ring interface may be lubricated to allow relative sliding between the rings. The lubrication helps improve toughness of the ring set assembly, in that interfacial cracks will not form in use or pre-stressing in assembly. Furthermore, cracks in individual rings will be absorbed in the lubricant film and not spread across to other rings, thus lessen the decompression on the die. Additionally during ring pre-loading in assembly, minimal or no tensile strain will develop at the interfaces of the rings that may gall the rings creating asperities that would otherwise reduce ring toughness. Lubrication may be between two surfaces in die/ring assembly when friction in the assembly is to be avoided. For example, the lubricant may be between the die core and a first ring. Additionally, a lubricant may be used between two or more consecutive rings in the assembly. Typical high pressure lubricants include molydisulphide and graphite sprays. Other lubricants may be used.

Exemplary Process for Forming a Die. Compression may be achieved by tension in the container system to keep the die core within the ring container system. The tension can be achieved by any number of ways, including but not limited to, material deformation in the container system from thermal contraction, chemical contraction, interference or a press fit, or by wrapping rings, foils, fibers or wire around the die core. In one embodiment, the die may be secured in the container system via cold or hot press fit, interference fit or chemical shrink e.g., heat-treat of the container system.

As used herein, term terms interference fit, a shrink fit and press fit refer to situations wherein the bore (e.g., containment system opening) is actually smaller than the shaft it is to be mated with (e.g. die) and wherein heat or a hydraulic press or another mechanical means is required to install. For example, the use of interference fit may create tension that results in irreversible deformation of the containment system and/or die. This ensures that the compression force is higher and more consistent than if the deformation were elastic and reversible.

Tension resulting from irreversible deformation in the die and/or container could also occur upon press fitting. Press fitting may be improved if the mating features of the die and/or container have dimensional asperities, surface roughness, burrs, scratches, or other irregularities. In some embodiments, the die core and each of the rings have mating geometrical features, such as to improve yield strength. These imperfections can result in local areas of high stress, exceeding the yield strength of the material and resulting in plastic deformation. For this reason and in one embodiment of the invention, some level of dimensional asperity is desirable as it increases the bonding force between the geometric features. On the other hand, hard asperities can lead to point loading on the hard die, causing it to potentially crack in die assembly. For this reason and in another embodiment of the invention, a grinding or polishing step may be used in the process of forming the die. Grinding or polishing may be used in the die/ring assembly and/or the ring/ring assembly.

In the process to form the die of the present invention, compression is defined by a number of factors including but not limited to: (a) the compressive strength of the die, (b) the tensile strength of the container system of rings, bands, fiber or wire wrap, etc., and (c) the tensile strength of the die-to-container and ring-to-ring or wire-to-wire interface. If the compression is too large, the die may crack or the container rings, foil or wire will crack. In one embodiment of the invention, compression may be adjusted to fit the space limitations by optimizing at least one of the ring yield strength, ring dimensions, radial interference, and the number of rings to achieve optimal compression without cracking the die. In another embodiment of the invention, the compression on the die may be adjusted to be comparable to the pressure developing the forming, drawing, extruding operation. Ideally, a die having a large number of rings is compressed until the die breaks, then compression is removed. When space is limiting, the approach may be to tensile-stress the dimensionally-fixed ringset to ring(s) breakage, then back off.

In one embodiment of any of the tension techniques, e.g., material deformation in the container system from thermal contraction, chemical contraction, interference or press fit, or by wrapping rings, foils, fibers and/or wire around the die core, etc. the assembled die is heated to further shrink and harden the containment rings to increase compression after press-fit and/or cooling. In one embodiment of this process, the container may be preheated or the die pre-cooled to alter their dimension prior to press fit and increase force by thermal-elastic strains.

Optionally, a supplemental, third-body wedge may be added between the die and the ring container system to, for example, prevent creep of the die back out of the container and augment compression of the die. This wedge may be in the form of a thin adhesive film or a thin metal foil or coating, such as a coating comprising lead or tin, may be placed on the die prior to fitting the ring container around the die core. The film helps to achieve void-free or substantially void-free contact and it may also augment the mechanical force by adhesion. Thin metal foils are commercially available from various sources including Wesgo, Allied Signal, and Vitta in thicknesses ranging from 0.0005 to 0.003 inches or more. In another example, an adhesive paste, wax, powder, or liquid may be used instead of a foil or film. Suitable adhesive materials for use in ceramic bonding are commercially available from a number of sources, including Durit® Metal-Adhesive Powder/Liquid from Bonadent GmbH, and Ceramabond™ from Aremco Products, Inc. In yet another embodiment, after a mechanical bond and/or interference fit is established through the technique such as those described above, a spot weld (point of braze or solder), or external container, may be introduced to further assure that the die is locked or held firmly in the container.

Surface forces from adhesion, friction, or asperity yielding may be exploited to improve the strength of the bond between the die and the container. However, surface forces may exceed the tensile strength of the die or container, causing an undesirable crack or chip. In one embodiment of a manufacturing process, surface forces with resulting non-uniform stresses that could cause local chips and cracks may be mitigated by the use of dry or wet lubricants such as graphite, hBN, oils, metallic soaps. These or other lubricants may be used to facilitate the fit of the die into the container without reducing the wedge action and mechanical force due to material yield.

Optionally, the life of a diamond wire drawing die may be extended further, with the reversible use of the ring container system as a die container. A broken die core may be removed from the pre-stressed container, unloading the container, and a new die core placed into it, re-establishing the same level of compression. Alternatively, in one embodiment, the entire die including the die core and the ring assembly may be processed and made such that it is relatively inexpensive and thus disposable. In one embodiment, instead of replacing the die core, the entire die may be replace because the die is relatively inexpensive.

Dies may be used for any shaping operation, such as in wire-drawing or extrusion techniques. In such applications, the workpiece, such as a wire or a bar stock may be deformed through the die creating internal pressure on the die. In order to reduce the internal stresses on the die and to extend life in operations, at least two rings of increasing diameter may be incorporated around the die core to create a housing. Shaping or forging applications, such as, for example, extruding non-circular or non-symmetric shapes, create non-uniform internal stress on the die. Dies may be supported by multiple ring sets oriented to counter those non-uniform stresses.

The examples below and as generally illustrated by the Figures are merely representative of the work that contributes to the teaching of the present invention, and the present invention is not to be restricted by the examples that follow.

EXAMPLE 1

Preparation of Rings of Increasing Diameter. A cylindrical AISI 4340 through-hardened steel ring having an outer diameter of 27.13 mm, inner diameter of 22.92 mm, and thickness 6.98 mm was turned on a lathe. The ring was chamfered on the inner diameter, 1 mm×45 degrees and deburred. Next, the ring inner diameter surface was lubricated with a thin film of Molylube MoS2. The ring was placed over a cylindrical die core comprised of polycrystalline diamond. The PCD wire die was Diamond Innovations, Inc. type 5725, which had an outer diameter of 24.13 mm. The die core and ring assembly were pressed together using a hydraulic press, with a total force applied being about 2000 kgf. The ring was then inspected for cracks and chips.

After the placement of the first ring of the smallest diameter, another ring that had a slightly larger outer diameter than the first ring was lubricated, placed over the compressed ring and the die core, and compressed with the hydraulic press. The ring was textured with a lathe. Rings of increasing diameter were added in this manner until a total of 5 metal rings were added to form the container system. After each compression, each ring was inspected, dimensions were verified, and the press force was monitored to ensure optimal compression and use of ring material strength. The die and ring assembly was then pressed into a soft stainless steel puck shape having a 76 mm diameter and a height of 36.8 mm. Also included was a pressed soft stainless steel plug, to encase the ring assembly and die in a safe container. Finally, a draw passage was made in the PCD die core by laser drilling, for a diameter of about 490 μm.

EXAMPLE 2

Alternative Preparation of Rings of Increasing Diameter. The steel rings were assembled first by pressing an inner ring into an outer ring, each in sequence for a total of five rings. The same hydraulic press was used. Each ring was lubricated on its outer diameter prior to being pressed to the next outer ring. As in Example 1, each assembled ring was inspected and press force monitored. After the rings were pressed together, a PCD wire die having similar dimensions as in Example 1 was lubricated on its outer diameter. The die core was then pressed into the ring set. The rings were inspected and gauged and then the entire assembly was pressed into a soft stainless steel container and laser drilled as in Example 1.

EXAMPLE 3

Comparison between Prior Art Die and Dies of Example 1 and 2.

A prior art die, similar to the one illustrated in FIG. 1, made of a hard die core 10 integrally bonded to a carbide housing 20 was obtained ("the prior art die"). Tungsten wires having a starting diameter of 650 μm are drawn through the draw passage of the prior art die and the dies of Examples 1 and 2. The service life of the diamond wire drawing die of the invention as described in Examples 1 and 2 is at least 20% longer than the comparative prior art die of Example 2. The dies of Examples 1 and 2 have been tested and operational for over 10 months.

EXAMPLE 4

Preparation of a Die having Rings of Increasing Diameter

Four D2 oil-hardened steel rings of HRC52-59 were machined to dimensions shown in Table 1. ID and OD refer to inner diameter and outer diameter respectively. The chamfering was accomplished according the process described in Example 1. The calculated radial interference refers to the tensile yield or deflection that each ring provides the die. The inner diameter bearing area refers to the surface area of the inner diameter of each of the rings. The Rings A-C are of increasing radial distance from the die core. Table 1.

TABLE 1

| | ID | OD | OD chamfer | ID chamfer | calc'd radial interference (in) | ID Bearing Area (in2) |
|---|---|---|---|---|---|---|
| PCD die actual | | 0.3175 | 0.010" × 45 deg | | | |
| A ring | 0.3174 | 0.4010 | 0.010" × 45 deg | 0.015" × 45 deg | −0.0001 | 0.499 |
| B ring | 0.3921 | 0.5025 | 0.002" × 45 deg | 0.010" × 45 deg | −0.0089 | 0.616 |
| C ring | 0.5011 | 0.6296 | 0.002" × 45 deg | 0.002" × 45 deg | −0.0014 | 0.787 |
| D ring | 0.6283 | 0.7890 | 0.002" × 45 deg | 0.002" × 45 deg | −0.0013 | 0.987 |

Each of the rings were ground to 0.113+/−0.001" thickness. This design provided approximately 390 ksi (195 ton/in$^2$) of radial compression on the die core. A PCD die core of type 5829 (by Diamond Innovations, Inc.) was used. The rings and PCD die were assembled using the mating chamfers to prevent gouging of the rings in assembly.

Shown in Table 2, Ring D's OD expanded an average apparent 0.63% (well above 0.2% tensile yield) upon assembly of Ring C. There was no support for Ring D. Therefore it was yielded completely.

TABLE 2

| | OD-unloaded | OD-loaded | lbs-force |
|---|---|---|---|
| D | 0.7890 | 0.7940 | 100 |

The next rings were assembled with deformations and forces reported in Table 3. In all cases the ID collapsed due to compression of the mating ring. Forces and deformation increased with each ring assembly. None of the rings fractured demonstrating the principle of cooperative support of each discrete ring.

TABLE 3

| | ID-loaded | ID-unloaded | lbs-force |
|---|---|---|---|
| D | 0.6299 | 0.6283 | 100 |
| C | 0.4995 | 0.5011 | 250 |
| B | 0.3897 | 0.3921 | 380 |
| A | 0.304 | 0.3174 | 2200 |

EXAMPLE 5

10 Dies assembled with 4 Rings of Increasing Diameter

Ten dies having a PCD die core were formed according to Example 4, each having four rings. The ID of the innermost Ring A for each of the ten is reported in Table 4. Assembly #1 cracked or yielded as demonstrated by the anomalous low ID collapse. The other 9 ring sets performed normally. Each die OD was 0.3175", the calculated average ring set interference, assuming no die deflection, was 3.2%. This is well above tensile yield strain of ~0.2% for any ring of steel. The action of the each pre-stressed ring is to increase the yield strength of the assembly.

TABLE 4

| Assembly# | ID | % ID collapse |
|---|---|---|
| 1 | 0.3132 | 1.34% |
| 2 | 0.304 | 4.41% |
| 3 | 0.3074 | 3.25% |
| 4 | 0.3052 | 4.00% |
| 5 | 0.3052 | 4.00% |
| 6 | 0.3106 | 2.19% |
| 7 | 0.307 | 3.39% |
| 8 | 0.3058 | 3.79% |
| 9 | 0.3102 | 2.32% |
| 10 | 0.306 | 3.73% |
| avg | 0.3075 | 3.24% |
| 1stdev | 0.0029 | 0.98% |

Measured axial assembly press forces for each ring and the die are shown in Table 5. The axial press force is used as an estimator of radial compression.

TABLE 5

| press | lbs per ring | lb/in2 |
|---|---|---|
| C | 10 | 10 |
| B | 166 | 211 |
| A | 1700 | 2760 |
| die | 5000 | 10029 |

What has been described and illustrated herein are embodiments of the invention along with some of their variations. The terms, descriptions and figures used herein are set forth by way of illustration only and are not meant as limitations. Those skilled in the art will recognize that many variations are possible within the spirit and scope of the invention, which is intended to be defined by the following claims and their equivalents in which all terms are meant in their broadest reasonable sense unless otherwise indicated. All citations referred herein are expressly incorporated herein by reference.

What is claimed is:

1. A disposable diamond die comprising:

a die core comprised of diamond; and a ring container system comprising at least two pre-stressed rings of increasing diameter placed around the die core, the pre-stressed condition of the rings establishing a deformed fit between the rings and the ring container system further providing a compression against the die core, wherein the at least two rings form a container housing the die core; and a housing comprising a housing container and a cap surrounding the two rings and die core.

2. The disposable die of claim 1, wherein the at least two rings comprise split rings, washers, sleeves, bands, wires, braids, or a combinations thereof.

3. The disposable die of claim 1, wherein the diamond comprise synthetic diamond, natural diamond, polycrystalline diamond, or a mixtures thereof.

4. The disposable die of claim 3, wherein the die is comprised of polycrystalline diamond.

5. The disposable die of claim 1, wherein at least one ring is comprised of a metal, a fiber reinforced composite, or a combination thereof.

6. The disposable die of claim 1, further comprising a retaining material positioned between the die core and a first of the rings or between a pair of consecutive rings.

7. The disposable die of claim 6, wherein the retaining material comprises a spot weld, a thin metal film, a foil, an adhesive foil, a coating, an adhesive, a wedge, a lubricant, or a combinations thereof.

8. The disposable die of claim 6, wherein the retaining material is located between each of the die core and a first ring, and each pair of consecutive rings.

9. The disposable die of claim 1, wherein the die has a diameter of about 1 to about 50 mm.

10. The disposable die of claim 1, wherein the die core and the rings have mating geometrical features.

11. The disposable die of claim 1, wherein the die core is generally cylindrical in shape.

12. A method for forming a disposable diamond die assembly comprising the steps of:

providing a die core comprised of diamond;

providing at least two rings of increasing diameter by establishing a pre-stressed condition between the at least two rings to form a pre-stressed ring container system;

securing the die core in the pre-stressed ring container system by contacting respective mating geometrical features between the ring container system and die core and causing a deformation in at least one of the mating geometrical feature, the deformation providing mechanical compression forces sufficient to secure the die core in the ring container system; and placing the ring container system with the secured die core into a container assembly.

13. The method of claim 12, wherein the securing comprises press fitting of the mating geometric features.

14. The method of claim 12, wherein the securing comprises shrink fitting of the mating geometric features.

15. The method of claim 12. wherein the mating geometric features have dimensions that creates an interference fit.

16. The method of claim 12, wherein the diamond comprises synthetic diamond, natural diamond, polycrystalline diamond, or a mixtures thereof.

17. The method of claim 12, wherein the at least two rings comprise at least one of a metal and a fiber reinforced composite.

18. The method of claim 12, further comprising the step of heat-treating the die at a temperature of at least about 300° C.

19. The method of claim 12, further comprising providing a retaining device positioned between the die core and a first of the rings.

20. The method of claim 19, wherein the retaining device comprises one or more of a spot weld, a thin metal film, a foil, an adhesive foil, a wedge, a lubricant, and a combination thereof.

* * * * *